US009079231B2

(12) United States Patent
Sandrin

(10) Patent No.: US 9,079,231 B2
(45) Date of Patent: Jul. 14, 2015

(54) FLAT METAL ALIGNMENT SYSTEM AND METHOD

(75) Inventor: Luca Sandrin, Terzo di Aquileia (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 347 days.

(21) Appl. No.: 13/695,418

(22) PCT Filed: May 2, 2011

(86) PCT No.: PCT/EP2011/056937

§ 371 (c)(1),
(2), (4) Date: Oct. 30, 2012

(87) PCT Pub. No.: WO2011/138264

PCT Pub. Date: Nov. 10, 2011

(65) Prior Publication Data

US 2013/0042661 A1 Feb. 21, 2013

(30) Foreign Application Priority Data

May 3, 2010 (IT) ..... MI2010A0771

(51) Int. Cl.

| | |
|---|---|
| ***B21B 39/16*** | (2006.01) |
| ***B21B 39/14*** | (2006.01) |
| ***B21B 39/06*** | (2006.01) |

(52) U.S. Cl.

CPC ..... *B21B 39/16* (2013.01); *B21B 39/06* (2013.01); *B21B 39/14* (2013.01)

(58) Field of Classification Search

CPC ..... B21B 39/02; B21B 39/14; B21B 39/16; B21B 39/165; B21B 39/06; B65H 9/10; B65H 5/16

USPC ..... 72/8.3, 11.1, 250, 251, 428

See application file for complete search history.

(56) References Cited

U.S. PATENT DOCUMENTS

| | | | | |
|---|---|---|---|---|
| 5,634,360 | A * | 6/1997 | Tazoe et al. | 72/12.5 |
| 6,332,492 | B1 * | 12/2001 | Donini et al. | 164/476 |
| 6,540,011 | B2 * | 4/2003 | Donini et al. | 164/476 |

FOREIGN PATENT DOCUMENTS

| | | |
|---|---|---|
| DE | 1483716 | 2/1969 |
| EP | 1125659 | 8/2001 |
| GB | 2271071 | 4/1994 |
| WO | WO 9924186 | 5/1999 |

OTHER PUBLICATIONS

Gruber, Ralph, "International Search Report," International Application No. PCT/EP2011/056937, European Patent Office (12 Pages), Date of mailing Oct. 17, 2011.

* cited by examiner

*Primary Examiner* — Peter DungBa Vo
*Assistant Examiner* — John S Lowe
(74) *Attorney, Agent, or Firm* — Stetina Brunda Garred & Brucker

(57) ABSTRACT

A flat metal aligning device (21) which allows the flat metal entering a rolling stand (22) of a rolling mill to be effectively aligned or centered by using retractable pusher elements to control the alignment and feeding of metal work pieces into the rolling stand, thus avoiding potential damage to the working rollers (2) while reducing the times to produce the rolled products. Moreover, the device according to the invention allows the rolling stand to be supplied with short slabs when they may not be fed by the motorized rollers at the stand inlet, precisely due to their short length.

12 Claims, 3 Drawing Sheets

FLAT METAL ALIGNMENT SYSTEM AND METHOD

FIELD OF THE INVENTION

The present invention relates to a flat metal aligning device used to align or center a flat metal, in particular a slab or a plate, entering a rolling stand of a rolling mill.

STATE OF THE ART

Currently, when feeding slabs or plates, the slab or plate may be not perfectly aligned when reaching the mouth of the rolling stand, in proximity of the working rollers. This drawback usually occurs in plate rolling mills. This drawback particularly occurs in case of short slabs, that is those slabs in which the width-to-length ratio is high in particular for low thickness magnitudes.

The traditional solution normally provides for the slab or plate to be pushed at a low speed, even lower than the rolling speed, towards the working rollers, which are normally arranged so that the gap between them is less than the rolling value required. The slab is pushed by the feeding rollers of the longitudinal feeding roller table towards the working rollers acting as true backstops. Once the slab has been aligned upon contacting the working rollers thus arranged, the movement of the feeding rollers is inverted and the slab is repositioned at a sufficient distance to be accelerated in the following step of inserting the same between the working rollers, in order to perform the rolling operation. Indeed, at the same time the working rollers are spaced apart so as to obtain a residual gap therebetween, which is equal to the value required by the rolling pass.

However, this traditional solution has the following disadvantages:

- by achieving the alignment or centering of the slab upon contacting the working rollers which are conveniently spaced apart, the impact of the slab on the working rollers may damage said working rollers;
- the time for handling the working rollers between a rolling pass and the next one for first centering and then rolling the following slab, as well as the time for handling the slab from the contact position with the rear working rollers up to reaching the acceleration position to ensure a correct inlet into the working rollers for the rolling operation, involve a significant increase of the total time needed to produce the rolled products.

Moreover, if the short slabs may not be fed by the motorized rollers at the stand inlet due to their short length and to possible bulging, the operation of centering the slabs entering the stand is quite problematic.

Thus the need is felt to provide a slab aligning device which allows to overcome the aforesaid drawbacks.

SUMMARY OF THE INVENTION

It is the primary object of the present invention to provide a flat metal aligning device which allows the flat metals, such as slabs or plates, entering a rolling stand of a rolling mill to be effectively aligned or centered, thus avoiding potential damages to the working rollers while reducing the production times of the rolled products.

It is a further object of the invention to feed the rolling stand with short flat metals when they may not be fed by the motorized rollers at the stand inlet, due to their short length and to bulging in the flat metal itself.

Therefore, the present invention suggests to achieve the above-discussed objects by providing a flat metal aligning device for aligning a flat metal entering a rolling stand, the device being adapted to cooperate with a longitudinal roller table underneath which allows the flat metal to be fed towards said rolling stand, said device comprising:

- side centering guides for centering the flat metal being fed on a longitudinal plane defined by said longitudinal roller table,
- pushing members for pushing the flat metal towards the rolling stand,
- first actuating means of said pushing members, each first actuating means actuating a respective pushing member, said first actuating means and respective pushing member being pivoted on a respective side centering guide,
- second actuating means, integrally fixed to each side centering guide, adapted to rotate said first actuating means and respective pushing member from a resting position over said longitudinal plane to a working position at said longitudinal plane, whereby the first actuating means actuate the respective pushing members to push and align the flat metal in proximity of the rolling stand.

A second aspect of the present invention provides a process of aligning flat metals entering a rolling stand, by means of the aforesaid device, the process comprising the following steps:

- centering a flat metal being fed on a longitudinal plane defined by the longitudinal roller table, by means of side centering guides;
- rotating the first actuating means and the respective pushing members, by means of the second actuating means, from a resting position over said longitudinal plane to a working position at said longitudinal plane;
- actuating the pushing members, by means of said first actuating means, to push and align the flat metal in proximity of the rolling stand.

The device and process of the invention advantageously involve a series of advantages as compared to the traditional solution of the state of the art, in particular:

- since the slab or plate is not aligned against the working rollers, knocks of the slab against the working rollers are avoided, as well as potential damages to said working rollers;
- the steps of approaching and then moving apart or opening the working rollers are suppressed and, therefore, the time for handling the working rollers between a rolling pass and the next one is reduced;
- the step in which the slab is moved back from the position in contact with the working rollers to the acceleration position is suppressed to ensure the correct inlet into the working rollers for the rolling operation, and therefore the time for preparing the slab in front of the working rollers is reduced, and thus the time between a rolling pass and the next one is reduced.

The dependent claims describe preferred embodiments of the invention.

BRIEF DESCRIPTION OF THE DRAWINGS

Further features and advantages of the invention will be more apparent in light of the detailed description of a preferred, but not exclusive, embodiment of a slab aligning device, shown by way of non-limiting example, with the aid of the accompanying drawings in which.

The same reference numbers in the figures identify the same elements or components.

DETAILED DESCRIPTION OF A PREFERRED EMBODIMENT OF THE INVENTION

Figure 1:
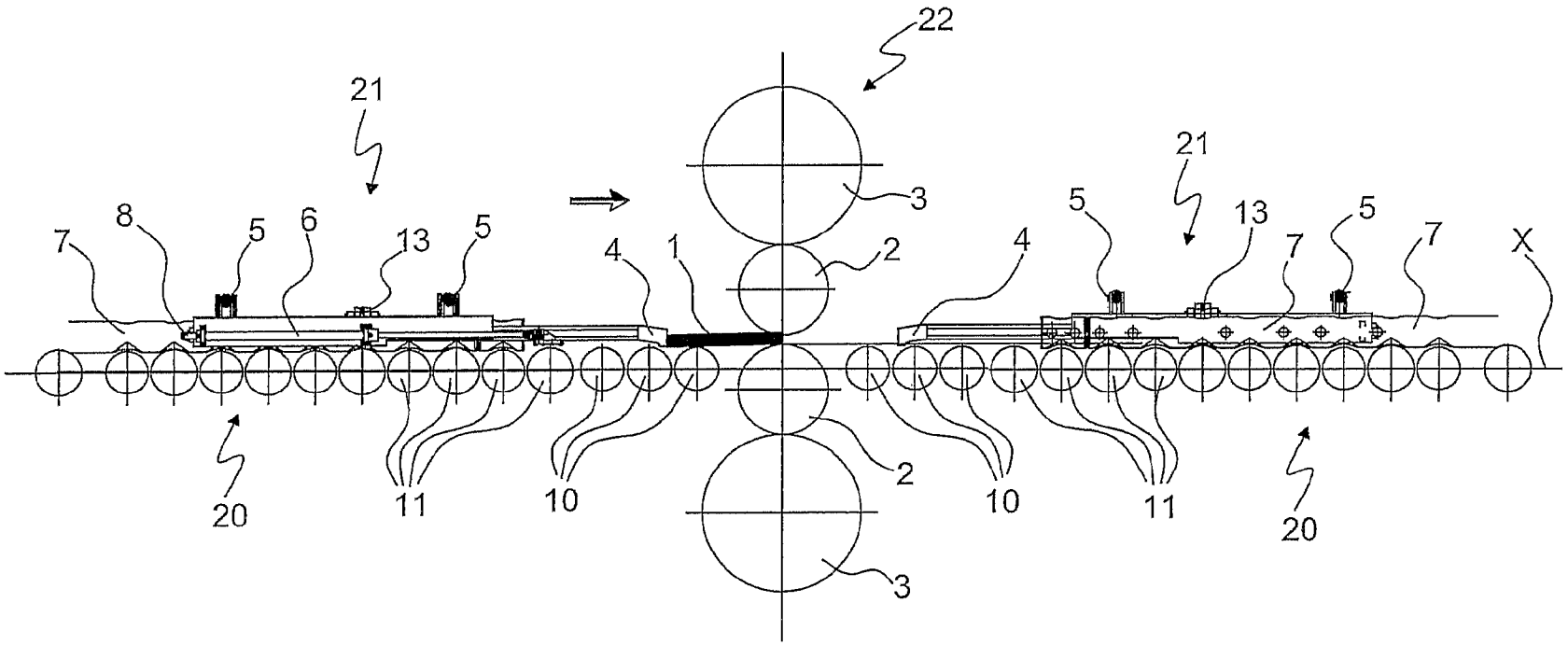
FIG. 1 shows a front view of the device according to the invention.

With reference to the figures, a first embodiment is shown of a slab aligning device, indicated by reference numeral 21 as a whole, for aligning the slabs entering a rolling stand of a rolling mill. The description of this device applies also to the case of alignment of plates.

Aligning a slab entering a rolling stand means placing the slab with its own longitudinal axis orthogonally to the axes of the working rollers of the rolling stand.

Thereby, when the slab is entering the stand, i.e when the slab is in contact with the working rollers, said front edge of the slab is ensured to be lying on the same plane in which the axes of both the working rollers of the stand lie.

In the case of a square or rectangular slab, aligning a slab entering a rolling stand coincides with aligning an axis of the slab with the rolling axis X.

A longitudinal roller table 20, conveniently motorized and comprising feeding rollers 11, allows slab 1 to be fed towards the rolling stand provided (in the configuration in FIG. 1) with working rollers 2 and back up rollers 3. For reversible rolling stands (as shown in FIG. 1 and FIG. 3), device 21 according to the invention may be provided both at the inlet of and outlet from the rolling stand 22.

The slab aligning device object of the present invention is arranged over the longitudinal roller table 20 and comprises:

- two side centering guides 7 of the slab being fed on the longitudinal roller table 20,
- two pushers 4, each pusher 4 being mounted to a respective centering guide 7,
- two first hydraulic cylinders 6 or other suitable first actuating means, each first hydraulic cylinder 6 actuating a respective pusher 4,
- two linear transducers 8, each linear transducer 8 controlling a respective first hydraulic cylinder 6 which may thus be actuated and controlled independently from the other first hydraulic cylinder,
- at least two second hydraulic cylinders 5 or other suitable actuating means, each second hydraulic cylinder 5 being integral with the structure of a respective centering guide 7 and adapted to rotate a respective frame 12 about a pin or fulcrum 9 fixed to said structure, frame 12 supporting a block comprising transducer 8, first hydraulic cylinder 6 and pusher 4.

Figure 3:
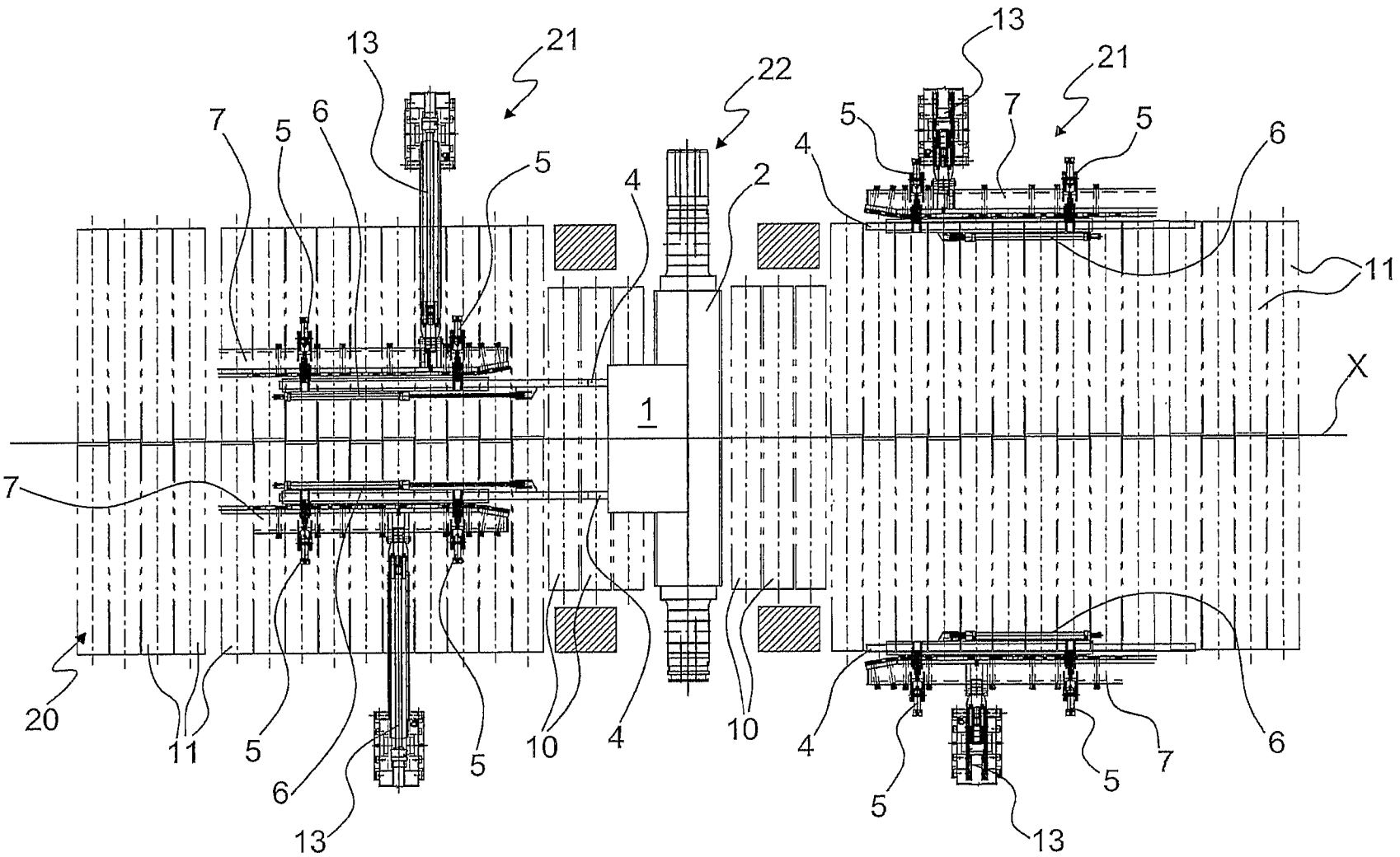
FIG. 3 shows a plan view of the device according to the invention.

A preferred variation, shown in FIGS. 1 and 3, includes four second hydraulic cylinders 5 within device 21, two for each side centering guide 7.

Figure 2:
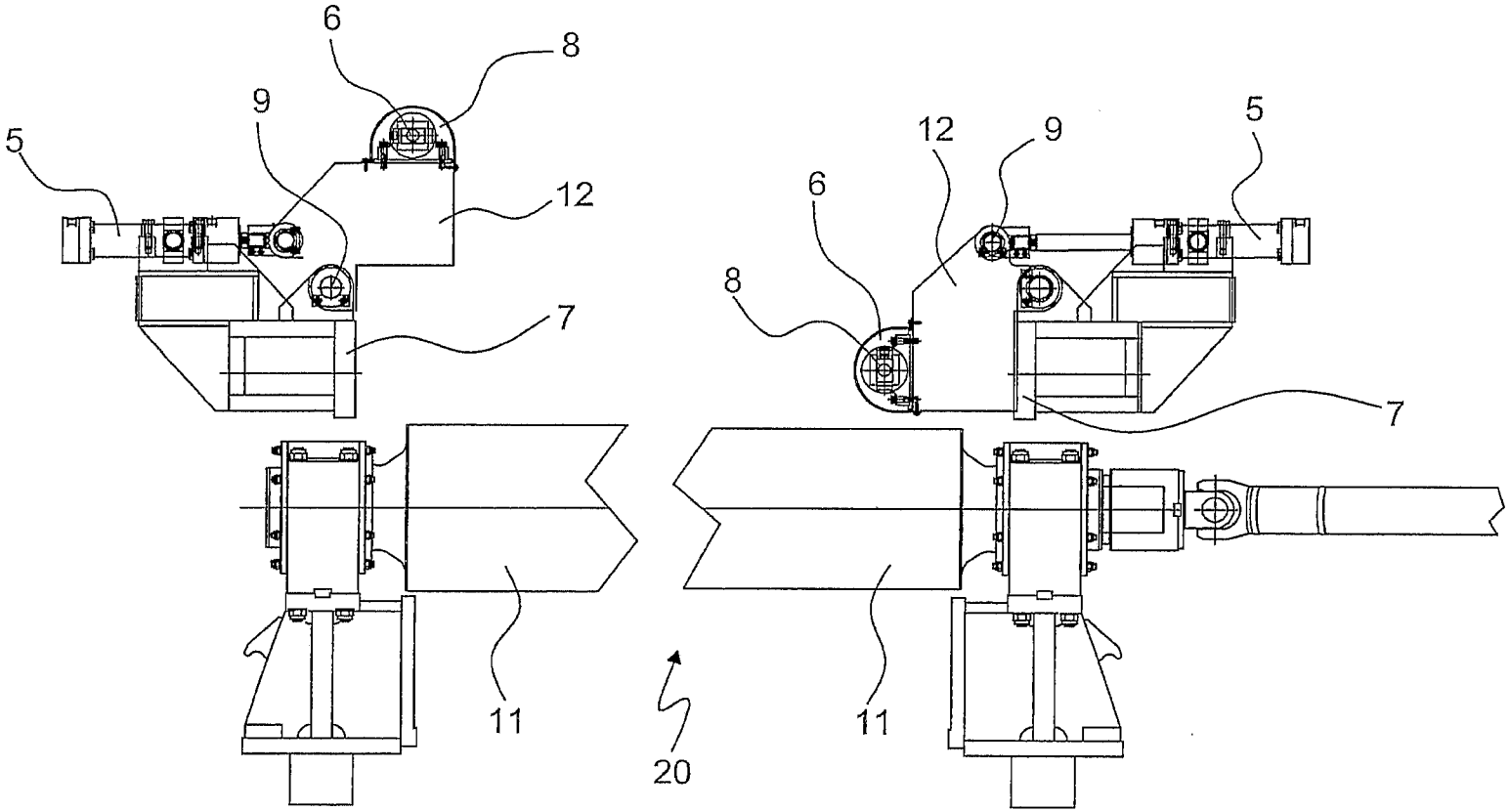
FIG. 2 shows a side view of the device according to the invention, in resting position (on the left) and in working position (on the right)

Alternatively to the hydraulic cylinders, first and second actuating means may comprise pneumatic cylinders, pinion-rack systems or mechanical lever systems, etc., for example. By actuating said second hydraulic cylinders 5, a shift may be made from a resting position (left-hand in FIG. 2), in which the so-called pusher assembly (comprising frame 12, transducer 8, hydraulic cylinder 6 and pusher 4) is facing upwards, having been rotated upwards about pin or fulcrum 9 to leave the path of the roller table 20 defined between said two side centering guides 7 completely free, to a working position (right-hand in FIG. 2), in which the so-called pusher assembly is rotated downwards about pin or fulcrum 9 to occupy part of the path of the roller Feeding rollers 10 are provided in proximity of the rolling stand 22 which lead the slab 1 pushed by pushers 4 towards the inlet between the working rollers 2.

The position of the side centering guides 7, which are provided with the respective pusher assembly, is not advantageously stationary over time but it may vary according to the width of the slab to be processed. Handling means 13 are indeed provided to move the side centering guides 7 transversally with respect to the longitudinal feeding axis or rolling axis X, so as to conveniently adjust the distance between the two centering guides 7 to center a slab of predetermined width.

With reference to the left part in FIGS. 1 and 3, slab 1 is fed by rollers 11, which are conveniently motorized, of the longitudinal roller table 20 and the feeding occurs due to friction between the surface of rollers 11 and the slab itself.

Alternatively, the roller table 20 may comprise, for example:

- perfectly cylindrical rollers 11, or
- rollers 11 having a first cylindrical half of a predetermined first diameter and a second cylindrical half of a predetermined second diameter which is smaller than the first diameter, said rollers 11 being alternately arranged so as to subject the slab being fed along the rolling axis X to twisting, thus allowing a rotation thereof, or
- rollers 11 having a truncated-cone shape, alternately arranged so as to subject the slab being fed along the rolling axis X to twisting,
- or two rollers 11 mounted coaxially on the same axis, i.e. one roller of the previous embodiment in this embodiment is replaced by two rollers, each having a length equal to about half of one single roller, these two rollers having their axis inclined toward the centre so that their external side lies slightly higher than the side at the centre; the left rollers, considered in the rolling direction, turn around their axis in the opposite direction to the turning direction of the right rollers, when the slab or plate moves forward.

The centering guides 7 are positioned on the roller table 20 by means of handling means 13, at such a distance to allow the slab 1 being fed to be centered.

When slab 1 is about to leave the section of roller table 20 between said centering guides 7, the second hydraulic cylinders 5 are actuated to rotate the so-called pusher assembly downwards (right-hand in FIG. 2), thus shifting from a resting position to a working position, so that the latter occupies part of the path of the roller table 20 between said centering guides 7.

At this point, the first hydraulic cylinders 6 are actuated thus allowing pushers 4, connected to the rod of the respective cylinder 6 or defining the rod of the respective cylinder 6, for example, to perfectly align slab 1 by pushing it towards the feeding rollers 10 before the slab itself is engaged by the working rollers 2. Linear transducers 8 are used to better control the two hydraulic cylinders 6 which may thus be actuated and controlled independently from each other.

Once slab 1 has been aligned and the starts to be rolled through the working rollers 2, pushers 4 are moved back to their retracted position, by means of the respective first hydraulic cylinders 6, and the second hydraulic cylinders 5 are actuated to rotate the pusher assembly upwards (left-hand in FIG. 2), thus shifting from the working position to the resting position, so that the path of the roller table 20 defined between said two side centering guides 7 is left completely free and the centering guides 7 are ready to be used for the regular operation of centering the next slab.

Therefore, the device according to the invention avoids the front hem of the slab from arriving not perfectly aligned with respect to the axis of the working rollers at the inlet below the working rollers 2 when feeding the slabs (even short slabs in which the width-to-length ratio is high), thus allowing an improved processing, fewer production rejects and less damage to the working rollers.

The invention claimed is:

1. A flat metal aligning device for aligning a flat metal entering a rolling stand, the device being adapted to cooperate with a longitudinal roller table underneath, which allows to feed the flat metal towards said rolling stand, said device comprising:

side centering guides for centering the flat metal being fed on a longitudinal plane defined by said longitudinal roller table, pushing members for pushing the flat metal towards the rolling stand, first actuating means of said pushing members, each first actuating means actuating a respective pushing member, said first actuating means and respective pushing member being pivoted on a respective side centering guide, second actuating means, integrally fixed to each side centering guide, adapted to rotate said first actuating means and respective pushing member from a resting position over said longitudinal plane to a working position at said longitudinal plane, whereby the first actuating means actuate the respective pushing members to push and align the flat metal in proximity of the rolling stand.

2. A device according to claim 1, wherein two side centering guides are provided.

3. A device according to claim 2, wherein two linear transducers are provided, each linear transducer controlling a respective first actuating means provided on one of the two side centering guides.

4. A device according to claim 2, wherein handling means are provided to move the side centering guides transversally to a rolling axis, so as to appropriately adjust the distance between the two side centering guides and center a flat metal of predetermined width.

5. A device according to claim 1, wherein there are at least two of said second actuating means, one for each side centering guide, each second actuating means being integral with a structure of the respective side centering guide and adapted to rotate a respective frame about a pivot fixed to said structure, the frame supporting a block comprising a linear transducer, a first actuating means and a pushing member.

6. A device according to claim 5, wherein four second actuating means are provided, two for each side centering guide.

7. A device according to claim 1, wherein the first actuating means are first hydraulic cylinders.

8. A device according to claim 7, wherein the second actuating means are second hydraulic cylinders.

9. A device according to claim 7, wherein the pushing members are either connected to a rod of the respective first hydraulic cylinder or coincide with the rod of the respective first hydraulic cylinder.

10. A rolling plant comprising a flat metal aligning device for aligning the flat metals entering a rolling stand, the aligning device being arranged over a longitudinal roller table, which allows the flat metals to be fed towards said rolling stand, said aligning device comprising:

side centering guides for centering the flat metal being fed on a longitudinal plane defined by said longitudinal roller table, pushing members for pushing the flat metal towards the rolling stand, first actuating means of said pushing members, each first actuating means actuating a respective pushing member, said first actuating means and respective pushing members being pivoted on a respective side centering guide, second actuating means, integrally fixed to each side centering guide, adapted to rotate said first actuating means and respective pushing member from a resting position over said longitudinal plane to a working position at said longitudinal plane, whereby the first actuating means actuate the respective pushing members to push and align the flat metal in proximity of the rolling stand.

11. A rolling plant according to claim 10, wherein the flat metal aligning device is provided either at the inlet or the outlet of the rolling stand.

12. A process of aligning flat metals entering a rolling stand, by means of an aligning device cooperating with a longitudinal roller table underneath, which allows to feed the flat metal towards said rolling stand, said aligning device comprising:

side centering guides for centering the flat metal being fed on a longitudinal plane defined by said longitudinal roller table, pushing members for pushing the flat metal towards the rolling stand, first actuating means of said pushing members, each first actuating means actuating a respective pushing member, said first actuating means and respective pushing member being pivoted on a respective side centering guide, second actuating means, integrally fixed to each side centering guide, adapted to rotate said first actuating means and respective pushing member from a resting position over said longitudinal plane to a working position at said longitudinal plane, whereby the first actuating means actuate the respective pushing members to push and align the flat metal in proximity of the rolling stand;

and the process comprising the following steps:

centering a flat metal being fed on a longitudinal plane defined by the longitudinal roller table, by means of side centering guides;

rotating the first actuating means and the respective pushing members, by means of the second actuating means, from a resting position over said longitudinal plane to a working position at said longitudinal plane;

actuating the pushing members, by means of said first actuating means, to push and align the flat metal in proximity of the rolling stand.

* * * * *